US009823604B2

(12) United States Patent
Kusukawa

(10) Patent No.: US 9,823,604 B2
(45) Date of Patent: Nov. 21, 2017

(54) IMAGE FORMING APPARATUS INCLUDING A SHEET MEMBER DISPOSED OVER REGION INCLUDING CLOSEST POSITION ON HOUSING AT WHICH CONVEYANCE MEMBER AND HOUSING ARE CLOSEST TO ONE ANOTHER

(71) Applicant: KYOCERA Document Solutions Inc., Osaka (JP)

(72) Inventor: Takashi Kusukawa, Osaka (JP)

(73) Assignee: KYOCERA Dodument Solutions Inc., Osaka (JP)

( * ) Notice: Subject to any disclaimer, the term of this patent is extended or adjusted under 35 U.S.C. 154(b) by 0 days.

(21) Appl. No.: 15/296,965

(22) Filed: Oct. 18, 2016

(65) Prior Publication Data

US 2017/0146928 A1 May 25, 2017

(30) Foreign Application Priority Data

Nov. 19, 2015 (JP) ..... 2015-226570

(51) Int. Cl.
*G03G 15/00* (2006.01)
*G03G 15/08* (2006.01)
*G03G 21/10* (2006.01)

(52) U.S. Cl.
CPC ..... *G03G 15/0891* (2013.01); *G03G 15/0812* (2013.01); *G03G 21/105* (2013.01); *G03G 2215/085* (2013.01)

(58) Field of Classification Search
CPC ..... G03G 15/0891; G03G 21/105; G03G 2215/0827; G03G 2215/085
USPC ..... 399/98, 256, 264, 358
See application file for complete search history.

(56) References Cited

U.S. PATENT DOCUMENTS

| | | | | |
|---|---|---|---|---|
| 4,832,233 A * | 5/1989 | Ichihara | G03G 15/0877 | 222/201 |
| 5,091,748 A * | 2/1992 | Morisawa | G03G 15/0896 | 399/281 |
| 2013/0108341 A1* | 5/2013 | Ikebata | G03G 21/105 | 399/358 |
| 2013/0216288 A1* | 8/2013 | Murata | G03G 21/105 | 399/358 |

FOREIGN PATENT DOCUMENTS

| | | | |
|---|---|---|---|
| JP | 05011669 A | * | 1/1993 |
| JP | 06067578 A | * | 3/1994 |
| JP | 10186988 A | * | 7/1998 |
| JP | 2007034340 A | * | 2/2007 |
| JP | 2008-129563 A | | 6/2008 |
| JP | 2008129219 A | * | 6/2008 |
| JP | 2010107930 A | * | 5/2010 |

* cited by examiner

*Primary Examiner* — Robert Beatty
(74) *Attorney, Agent, or Firm* — Studebaker & Brackett PC

(57) ABSTRACT

An image forming apparatus includes a housing, a conveyance member, and a sheet member. The housing forms a conveyance path along which toner is conveyed. The conveyance member is supported by the housing. The conveyance member rotates about a rotation axis thereof to convey the toner. The sheet member is disposed on a contact region of the housing where the conveyance member comes in contact with the housing.

14 Claims, 6 Drawing Sheets

IMAGE FORMING APPARATUS INCLUDING A SHEET MEMBER DISPOSED OVER REGION INCLUDING CLOSEST POSITION ON HOUSING AT WHICH CONVEYANCE MEMBER AND HOUSING ARE CLOSEST TO ONE ANOTHER

INCORPORATION BY REFERENCE

The present application claims priority under 35 U.S.C. §119 to Japanese Patent Application No. 2015-226570, filed on Nov. 19, 2015. The contents of this application are incorporated herein by reference in their entirety.

BACKGROUND

The present disclosure relates to image forming apparatuses.

Toner may remain on a surface of a photosensitive drum in a generic electrophotographic image forming apparatus. In one example, an image forming apparatus has a cleaning device for cleaning residual toner remaining on a surface of a photosensitive drum therein. The cleaning device uses a cleaning member such as a fur brush or a cleaning blade to remove the residual toner. After being removed, the toner is caused to drop into a waste toner conveyance path.

A conveyance screw for conveying the waste toner is disposed in the waste toner conveyance path. A conveyance member typically includes a helical blade. The waste toner is conveyed along the conveyance path as the helical blade rotates. After being conveyed along the conveyance path, the waste toner drops into a collection container. Through the above, the waste toner is collected in the collection container.

SUMMARY

An image forming apparatus according to an aspect of the present disclosure includes a housing, a conveyance member, and a sheet member. The housing forms a conveyance path along which toner is conveyed. The conveyance member is supported by the housing. The conveyance member rotates about a rotation axis thereof to convey the toner. The sheet member is disposed on a contact region of the housing. The contact region is a region where the conveyance member comes in contact with the housing.

DETAILED DESCRIPTION

Figure 1:
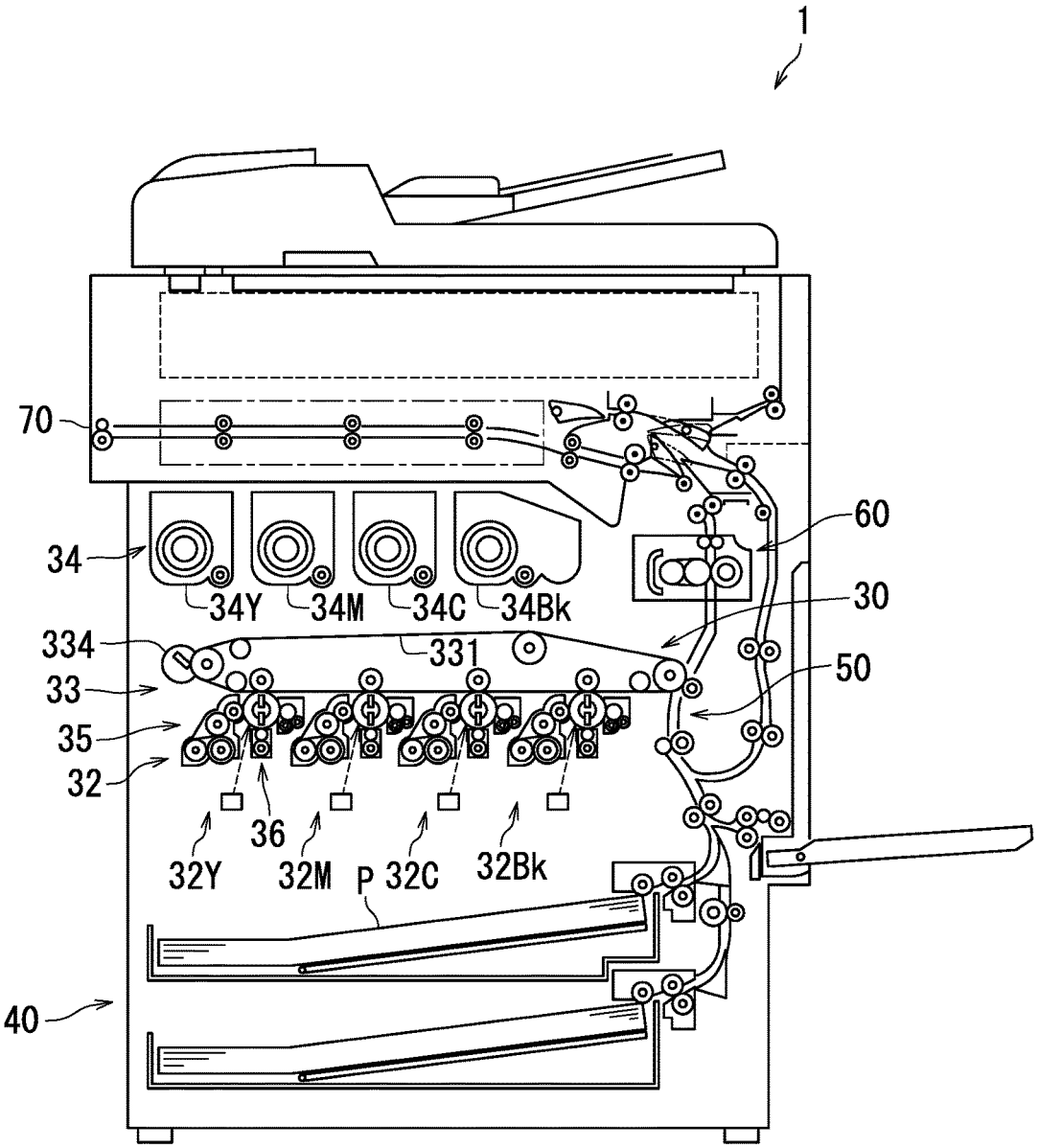
FIG. 1 is a cross-sectional view illustrating an image forming apparatus according to an embodiment of the present disclosure.

The following describes an embodiment of the present disclosure with reference to the drawings. Elements that are the same or equivalent are marked using the same reference signs in the drawings and description thereof is not repeated.

The following describes an image forming apparatus 1 according to an embodiment of the present disclosure with reference to FIG. 1. FIG. 1 is a cross-sectional view illustrating an internal structure of the image forming apparatus 1 according to the embodiment of the present disclosure. The description herein is made using a multifunction peripheral having a printing function and a copy function as an example of the image forming apparatus 1. However, the image forming apparatus 1 may for example be a printer, a copier, or a facsimile machine.

The image forming apparatus 1 includes an image forming section 30, a fixing section 60, and a paper feed section 40. The image forming apparatus 1 includes a conveyance path 50. The image forming section 30 forms a toner image on paper P, which is a transfer target. The fixing section 60 fixes the toner image on the paper P. Standard-size paper P to be conveyed to the image forming section 30 is loaded in the paper feed section 40. Along the conveyance path 50, the paper P is conveyed from the paper feed section 40 to a paper exit port 70 through the image forming section 30 and the fixing section 60.

The image forming section 30 transfers a full-color toner image onto the paper P. The image forming section 30 includes an image forming unit 32, an intermediate transfer unit 33, and a toner replenishing section 34. The image forming unit 32 includes four image forming units 32Y, 32M, 32C, and 32Bk for respectively forming toner images in yellow Y, magenta M, cyan C, and black Bk. Each of the image forming units 32Y, 32M, 32C, and 32Bk includes a developing unit 35 and a photosensitive unit 36.

The intermediate transfer unit 33 includes an intermediate transfer belt 331 and a cleaning device 334. The intermediate transfer belt 331 is an endless belt. The cleaning device 334 removes toner remaining on an outer circumferential surface of the intermediate transfer belt 331.

The toner replenishing section 34 includes a yellow-color toner container 34Y, a magenta-color toner container 34M, a cyan-color toner container 34C, and a black-color toner container 34Bk. The toner containers 34Y 34M, 34C, and 34Bk respectively contain toners in yellow Y, magenta M, cyan C, and black Bk. The toners in yellow Y, magenta M, cyan C, and black Bk are respectively supplied from the toner containers 34Y, 34M, 34C, and 34Bk to the developing units 35 of the image forming units 32Y, 32M, 32C, and 32Bk through supply paths, not illustrated.

Figure 2A:
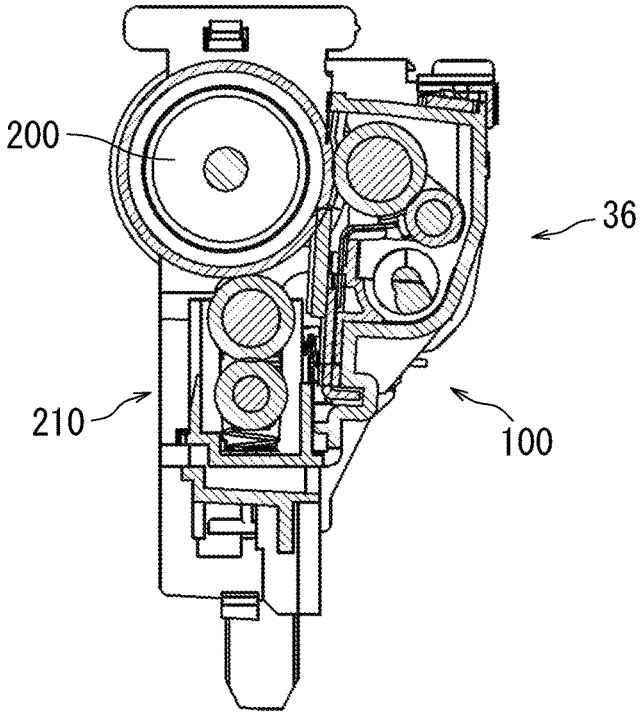
FIG. 2A is a cross-sectional view of a photosensitive unit according to the embodiment of the present disclosure.
Figure 2B:
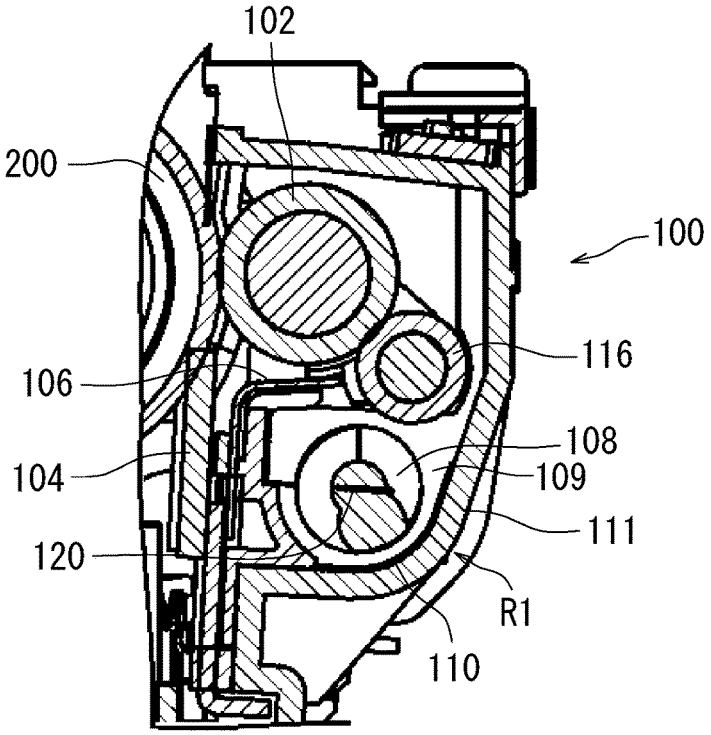
FIG. 2B is a cross-sectional view of a cleaner according to the embodiment of the present disclosure.

The following describes a cleaner 100 according to the embodiment of the present disclosure with reference to FIGS. 1, 2A and 2B. FIG. 2A is a cross-sectional view of one photosensitive unit 36 according to the embodiment of the present disclosure. FIG. 2B is a cross-sectional view of the cleaner 100 according to the embodiment of the present disclosure.

As illustrated in FIG. 2A, the photosensitive unit 36 has a photosensitive drum 200, a charger 210, and the cleaner 100. The charger 210 uniformly charges a circumferential surface of the photosensitive drum 200. The developing unit 35 (see FIG. 1) forms a toner image on the circumferential surface of the photosensitive drum 200. The cleaner 100 cleans the photosensitive drum 200.

As illustrated in FIG. 2B, the cleaner 100 has a friction roller 102, a cleaning blade 104, a plate roll 106, a conveyance screw 108 (conveyance member), a sheet member 110, a housing 111, a supply roller 116, and a toner eliminating sheet 120 (toner removing member).

The friction roller 102 is disposed opposite to the photosensitive drum 200 so as to be rotatable about its rotation axis. The rotational speed of the friction roller 102 is different from the rotational speed of the photosensitive drum 200. For example, the rotational speed of the friction roller 102 is faster than the rotational speed of the photosensitive drum 200. The friction roller 102 includes a metal shaft and an elastic member such as urethane foam covering the metal shaft. A toner layer having a uniform thickness is formed on a surface of the friction roller 102. The toner for example contains a titanium oxide as an abrasive. The friction roller 102 is in contact with a surface of the photosensitive drum 200 and scrapes against the photosensitive drum 200. The friction roller 102 scrapes against the photosensitive drum 200 thereby to abrade ionic products that are formed on the surface of the photosensitive drum 200 during image formation.

The cleaning blade 104 removes residual toner adhering to the surface of the photosensitive drum 200. The cleaning blade 104 is disposed such that an end of the cleaning blade 104 is in contact with the surface of the photosensitive drum 200. The cleaning blade 104 is for example made from rubber.

The plate roll 106 is disposed under the friction roller 102. The plate roll 106 has a plate-like shape elongated in a direction of the rotation axis of the friction roller 102. The plate roll 106 is for example made from a metal. The plate roll 106 receives toner removed from the photosensitive drum 200 by the cleaning blade 104. Thus, toner removed from the photosensitive drum 200 accumulates on the plate roll 106. Toner on the plate roll 106 comes in contact with the friction roller 102 to adhere to the surface of the friction roller 102.

The housing 111 forms a conveyance path 109 along which the toner is conveyed. Toner that has fallen off the plate roll 106 accumulates on the conveyance path 109.

The conveyance screw 108 has a helical shape and is elongated in the direction of the rotation axis of the friction roller 102. The conveyance screw 108 is supported by the housing 111. The conveyance screw 108 rotates about its rotation axis thereby to convey toner on the conveyance path 109. The conveyance screw 108 for example conveys toner to a waste toner container.

The sheet member 110 is disposed on a contact region R1 of the housing 111. The contact region is a region where the conveyance screw 108 can come in contact with the housing 111. The sheet member according to the present embodiment is disposed on a curved surface of the housing 111. The sheet member 110 is located under the toner eliminating sheet 120. The sheet member 110 is a highly slidabie and durable sheet. The sheet member 110 is for example a high-molecular polyethylene sheet. The sheet member 110 has two surfaces, one of which is a bonding surface having a bonding agent applied thereto. The sheet member 110 is attached to the housing 111 by putting the bonding surface on the curved surface of the housing 111.

The supply roller 116 is rotatably disposed opposite to the friction roller 102. The supply roller 116 passively rotates in accompaniment to rotation of the friction roller 102. The supply roller 116 restricts the thickness of the toner layer that is formed on the surface of the friction roller 102. More specifically, in a situation in which the thickness of the toner layer formed on the surface of the friction roller 102 is larger than a distance between the friction roller 102 and the supply roller 116, the thickness of the toner layer formed on the surface of the friction roller 102 is reduced to a uniform thickness through the supply roller 116 coming in contact with the friction roller 102. Excess toner removed through the supply roller 116 reducing the thickness of the toner layer to a uniform thickness accumulates on the conveyance path 109 and is conveyed by the conveyance screw 108.

The toner eliminating sheet 120 abuts the conveyance screw 108 thereby to remove toner adhering to the conveyance screw 108. The toner eliminating sheet 120 is for example made from a polyethylene resin. The toner eliminating sheet 120 will be described later in detail with reference to FIG. 6.

As described above with reference to FIGS. 1, 2A, and 2B, the sheet member 110 is disposed on the contact region R1 of the housing 111 where the conveyance screw 108 can come in contact with the housing 111. Thus, the conveyance screw 108 can be prevented from coming in direct contact with the housing 111 of the cleaner 100. As a result, abnormal noise and scuffing of the housing of the cleaner can be inhibited.

The sheet member 110 preferably includes an elastic material. The elastic material is for example silicone rubber or urethane. As a result of the sheet member 110 including an elastic material, vibration generated when the conveyance screw 108 comes in contact with the housing 111 of the cleaner 100 is absorbed. Consequently, vibration of the housing 111 can be reduced.

Figure 3:
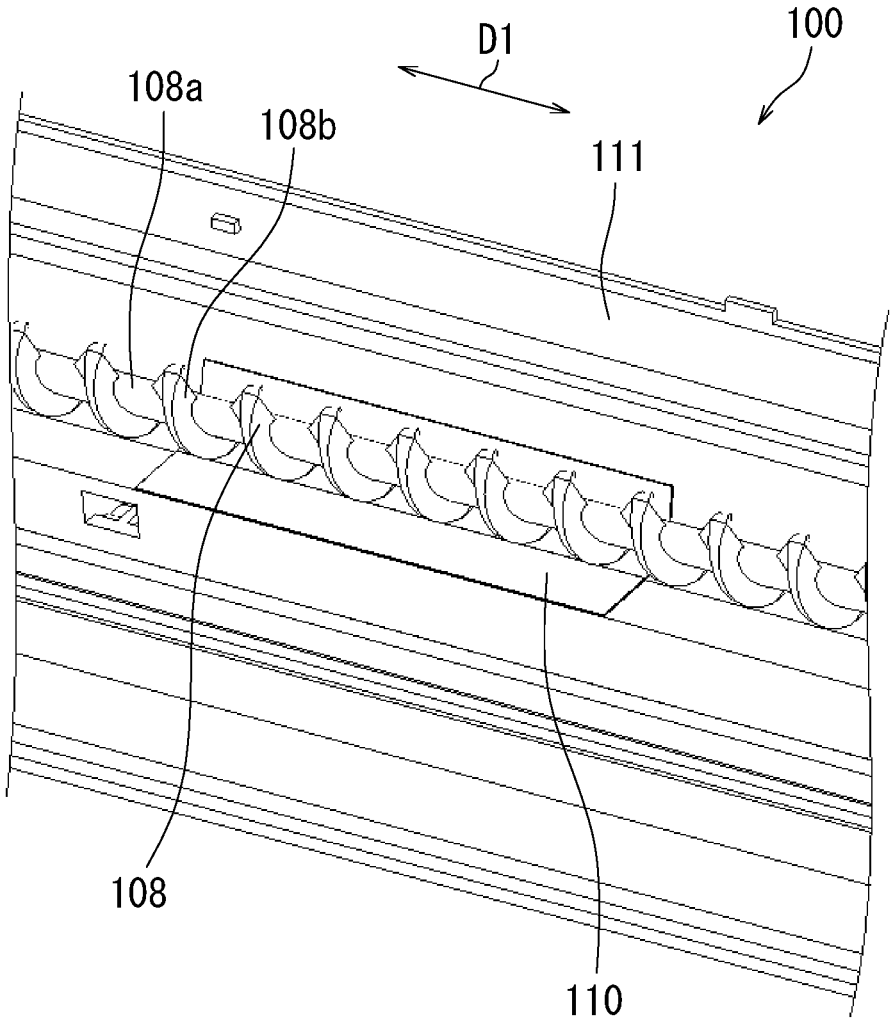
FIG. 3 is a perspective view of a region of the cleaner according to the embodiment of the present disclosure in the vicinity of a sheet member.
Figure 4:
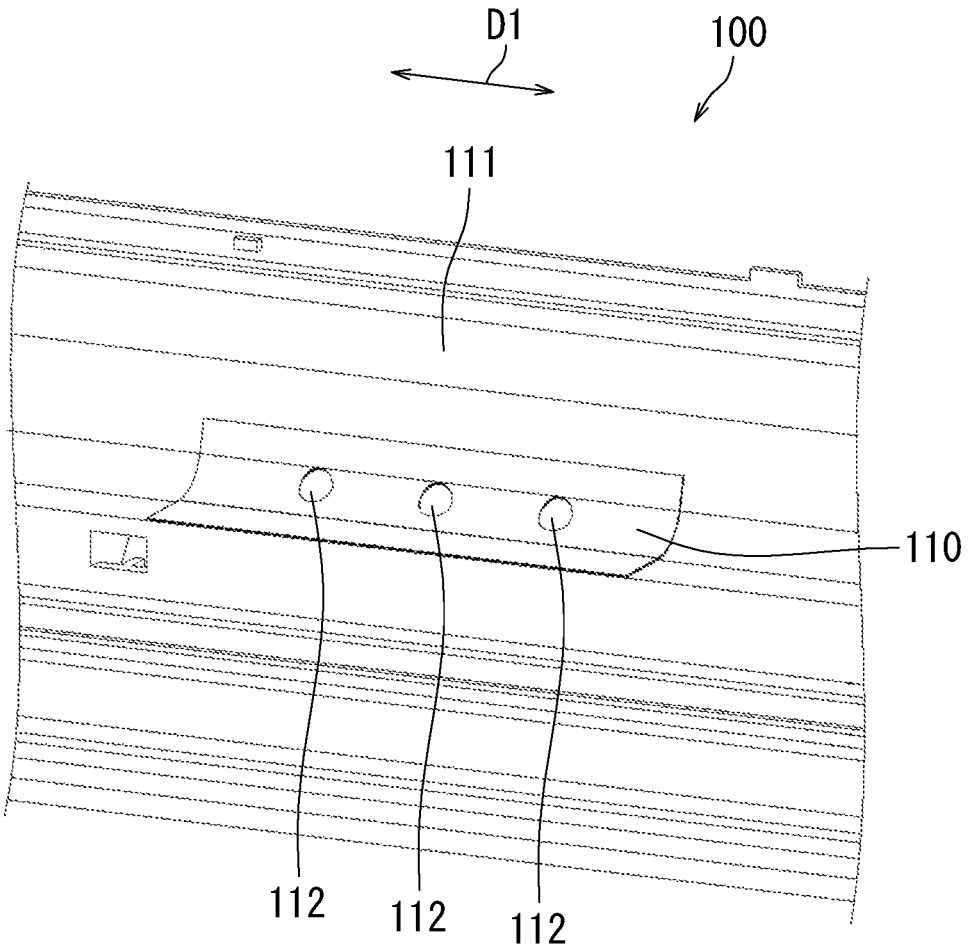
FIG. 4 is a perspective view of a region of the cleaner according to the embodiment of the present disclosure in the vicinity of the sheet member.

The following further describes the sheet member 110 with reference to FIGS. 3 and 4. FIGS. 3 and 4 are each a perspective view of a region of the cleaner 100 according to the embodiment of the present disclosure in the vicinity of the sheet member 110. Note that the conveyance screw 108 is not shown in FIG. 4.

As illustrated in FIG. 3, a length of the sheet member 110 in a direction D1 of a rotation shaft 108*a* of the conveyance screw 108 is shorter than a length of the conveyance screw 108 in the direction D1 of the rotation shaft 108*a*. The conveyance screw 108 has the rotation shaft 108*a* and a helical blade 108*b*. The helical blade 108*b* is formed around the rotation shaft 108*a*. Ends of the rotation shaft 108*a* are supported by the housing 111 of the cleaner 100. The conveyance screw 108 is more flexible at a middle thereof than at the supported ends. Therefore, the sheet member 110 is preferably disposed at a middle of the housing 111 in terms of the direction D1 of the rotation shaft 108*a*. As a result, the conveyance screw 108 can be prevented from coming in direct contact with the housing 111. The sheet member 110 is disposed under the rotation shaft 108*a*.

As illustrated in FIG. 4, the sheet member 110 preferably has three holes 112. The holes 112 are circular. The three holes 112 are in an equally spaced linear arrangement along the direction D1 of the rotation shaft 108*a*. As a result of the sheet member 110 having the holes 112, generation of bubbles can be reduced when the sheet member 110 is attached to the housing 111. Thus, the sheet member 110 can be attached such that the sheet member 110 has no curves or bumps. As a result, the conveyance screw 108 can be prevented from coming in excess contact with the sheet member 110.

Figure 5:
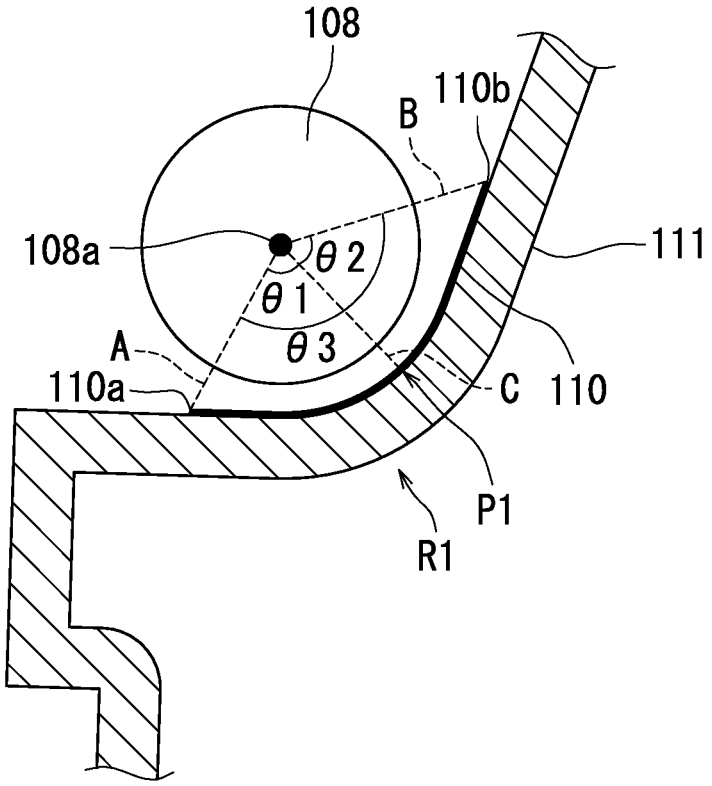
FIG. 5 is a cross-sectional view of a region of the cleaner according to the embodiment of the present disclosure in the vicinity of the sheet member.

The following further describes the sheet member 110 with reference to FIG. 5. FIG. 5 is a cross-sectional view of a region of the cleaner 100 according to the embodiment of the present disclosure in the vicinity of the sheet member 110. A closest position P1 is a position on the housing 111 at which the conveyance screw 108 and the housing 111 are closest to one another.

As illustrated in FIG. 5, the sheet member 110 is preferably disposed on the housing 111 over a ±60° range from the closest position P1 about the rotation shaft 108*a* of the conveyance screw 108. In FIG. 5, θ1 is an angle formed by an imaginary plane A including the rotation shaft 108*a* and one end 110*a* of the sheet member 110, and an imaginary plane C including the rotation shaft 108*a* and the closest position P1. θ1 is 60°. θ2 is an angle formed by an imaginary plane B including the rotation shaft 108*a* and the other end 110*b* of the sheet member 110, and the imaginary plane C including the rotation shaft 108*a* and the closest position P1. θ2 is 60°. θ3 is an angle formed by the imaginary plane A including the rotation shaft 108*a* and the one end 110*a*, and the imaginary plane B including the rotation shaft 108*a* and the other end 110*b*. θ3 is 120°. In the present embodiment, θ1 is equal to θ2. Accordingly, even if the conveyance screw 108 deflects upwardly or downwardly relative to the closest position P1, the conveyance screw 108 can be prevented from coming in direct contact with the housing 111 of the cleaner 100.

Figure 6:
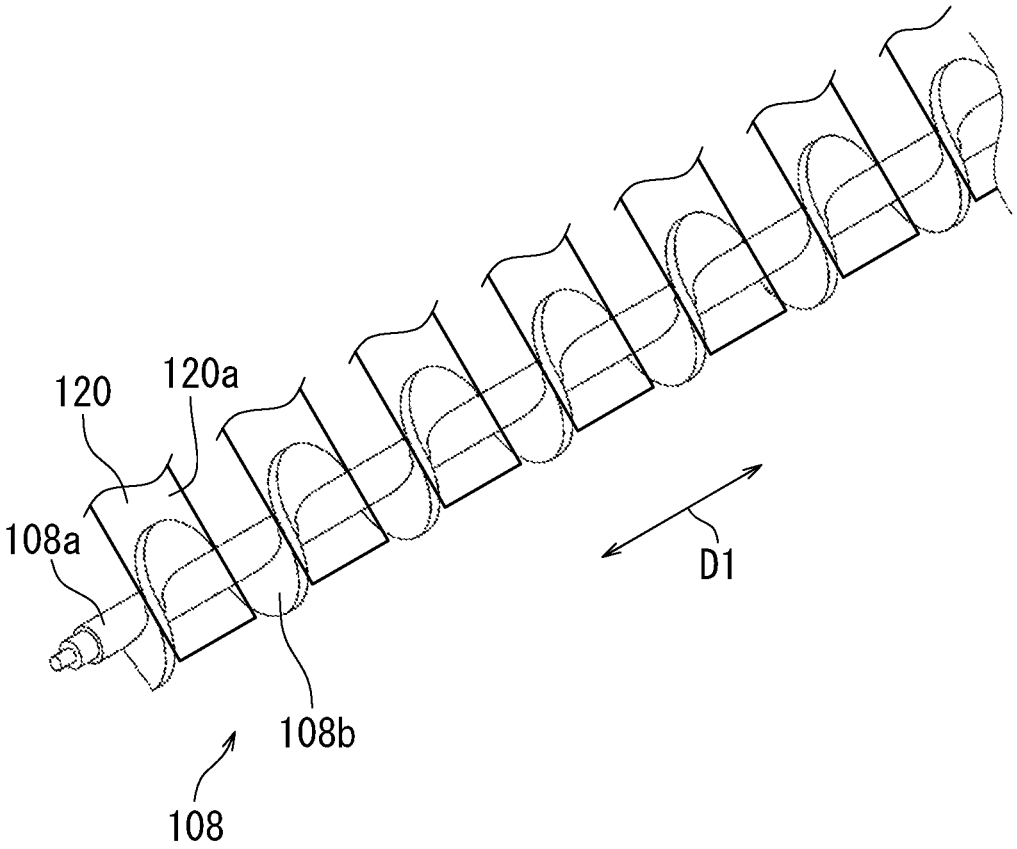
FIG. 6 is a perspective view of a conveyance screw and a toner eliminating sheet of the cleaner according to the embodiment of the present disclosure.

The following describes the toner eliminating sheet 120 with reference to FIG. 6. FIG. 6 is a perspective view of the conveyance screw 108 and the toner eliminating sheet 120 in the cleaner 100 according to the embodiment of the present disclosure.

The toner eliminating sheet 120 includes a plurality of contact sections 120*a*. The contact sections 120*a* are arranged in the direction D1 of the rotation shaft 108*a* at intervals in accordance with the helical pitch of the helical blade 108*b*. The contact sections 120*a* abut the rotation shaft 108*a* and the helical blade 108*b* of the conveyance screw 108. As the conveyance screw 108 rotates, the contact sections 120*a* of the toner eliminating sheet 120 abut the rotation shaft 108*a* and the helical blade 108*b* to remove toner adhering to the rotation shaft 108*a* and the helical blade 108*b*. As a result, impairment of toner conveyance due to toner adhering to the conveyance screw 108 can be inhibited.

The toner eliminating sheet 120 repeats being pushed upward by the helical blade 108*b* and returning to its original position as the conveyance screw 108 rotates. Due to the resilience that allows the toner eliminating sheet 120 to return to its original position, the conveyance screw 108 tends to deflect downwardly. However, the cleaner 100 has the sheet member 110, and thus the possibility that the conveyance screw 108 comes in direct contact with the housing 111 can be reduced. As a result, abnormal noise and scuffing of the housing 111 can be inhibited.

The embodiment of the present disclosure has been described with reference to the drawings (FIGS. 1 to 6) so far. However, the present disclosure is not limited to the above-described embodiment and can be practiced in various ways within the scope without departing from the essence of the present disclosure (for example, as described below in sections (1) to (5)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiment, such as material properties, shapes, and dimensions, are merely examples and are not intended as specific limitations. Various alterations may be made so long as there is no substantial deviation from the effects of the present disclosure.

(1) The sheet member 110 in the image forming apparatus 1 described with reference to FIGS. 1 to 6 is disposed on the housing 111 of the cleaner 100. However, the present disclosure is not limited to such a configuration. For example, in the image forming apparatus 1 illustrated in FIG. 1, the sheet member 110 may be disposed on a housing for a toner conveyance path in the developing unit 35, a housing for a toner conveyance path of the cleaning device 334 for cleaning the intermediate transfer belt 331, or a housing for a toner conveyance path of the toner replenishing section 34.

(2) The sheet member 110 in the image forming apparatus 1 described with reference to FIGS. 1 to 6 has three holes 112. However, the present disclosure is not limited to such a configuration. The sheet member 110 may have one hole 112, two holes 112, or four or more holes 112.

(3) The holes 112 in the sheet member 110 in the image forming apparatus 1 described with reference to FIGS. 1 to 6 are circular. However, the present disclosure is not limited to such a configuration. The holes 112 in the sheet member 110 may be quadrangular or hexagonal.

(4) The holes 112 in the sheet member 110 in the image forming apparatus 1 described with reference to FIGS. 1 to 6 are in a linear arrangement. However, the present disclosure is not limited to such a configuration. The holes 112 may for example be in a staggered arrangement.

(5) The cleaner 100 in the image forming apparatus 1 described with reference to FIGS. 1 to 6 has the toner eliminating sheet 120. However, the present disclosure is not limited to such a configuration. The cleaner 100 may for example have no toner eliminating sheet 120.

What is claimed is:

1. An image forming apparatus comprising:

a housing forming a conveyance path along which toner is conveyed;

a conveyance member supported by the housing and configured to rotate about a rotation axis thereof to convey the toner; and a sheet member disposed over a region including a closest position, the region including the closest position being a region of the housing, the closest position being a position on the housing at which the conveyance member and the housing are closest to one another, wherein the sheet member has at least one hole.

2. The image forming apparatus according to claim 1, wherein a length of the sheet member in a direction of the rotation axis is shorter than a length of the conveyance member in the direction of the rotation axis.

3. The image forming apparatus according to claim 1, wherein the sheet member is disposed at a middle of the housing in terms of a direction of the rotation axis.

4. The image forming apparatus according to claim 1, wherein the sheet member is disposed under the rotation axis.

5. The image forming apparatus according to claim 1, wherein the sheet member is disposed over a ±60° range from the closest position about the rotation axis.

6. The image forming apparatus according to claim 5, wherein an angle formed by an imaginary plane including the rotation axis and one end of the sheet member, and an imaginary plane including the rotation axis and the closest position is equal to an angle formed by an imaginary plane including the rotation axis and another end of the sheet member, and the imaginary plane including the rotation axis and the closest position.

7. The image forming apparatus according to claim 1, wherein the sheet member is disposed on a curved surface of the housing.

8. The image forming apparatus according to claim 1, wherein the at least one hole is a plurality of holes, and the holes are in a linear arrangement.

9. The image forming apparatus according to claim 1, wherein the at least one hole is a plurality of holes, and the holes are in a staggered arrangement.

10. The image forming apparatus according to claim 1, wherein the at least one hole is a plurality of holes, and the holes are in an equally spaced arrangement.

11. The image forming apparatus according to claim 1, further comprising a toner removing member disposed in contact with the conveyance member and configured to remove the toner adhering to the conveyance member.

12. The image forming apparatus according to claim 11, wherein the sheet member is disposed under the toner removing member.

13. The image forming apparatus according to claim 1, wherein the sheet member includes an elastic material.

14. An image forming apparatus comprising:

a housing forming a conveyance path along which toner is conveyed;

a conveyance member supported by the housing and configured to rotate about a rotation axis thereof to convey the toner;

a sheet member disposed over a region including a closest position, the region including the closest position being a region of the housing, the closest position being a position on the housing at which the conveyance member and the housing are closest to one another; and a toner removing member disposed in contact with the conveyance member and configured to remove the toner adhering to the conveyance member, wherein the sheet member is disposed under the toner removing member.

* * * * *